US006543197B2

(12) United States Patent
Wetzel, III et al.

(10) Patent No.: US 6,543,197 B2
(45) Date of Patent: Apr. 8, 2003

(54) SNAP-FIT PANEL CONNECTION APPARATUS

(75) Inventors: John Wetzel, III, Sparta, IL (US); Curtis B. Hemann, Breese, IL (US); Jeffrey L. Hall, Breese, IL (US); Frank J. DeBoer, O'Fallon, IL (US); Michael A. Spicer, Trenton, IL (US); Steven D. Huegen, Bartelso, IL (US); Timothy J. Brennan, Lebanon, IL (US)

(73) Assignee: Arrow Group Industries, Inc., Wayne, NJ (US)

( * ) Notice: Subject to any disclaimer, the term of this patent is extended or adjusted under 35 U.S.C. 154(b) by 0 days.

(21) Appl. No.: 09/927,848

(22) Filed: Aug. 10, 2001

(65) Prior Publication Data

US 2003/0029113 A1 Feb. 13, 2003

(51) Int. Cl.[7] ..... E04C 3/30; E04B 2/00; E04B 2/08

(52) U.S. Cl. ..... 52/581; 52/588.1; 52/589.1

(58) Field of Search ..... 52/581, 588.1, 52/589.1

(56) References Cited

U.S. PATENT DOCUMENTS

| | | | |
|---|---|---|---|
| 817,508 | A | 4/1906 | Niele |
| 1,196,133 | A | 8/1916 | Moister |
| 1,427,007 | A | 8/1922 | Maisenhalder |
| 1,803,589 | A | 5/1931 | Bohnsack |
| 2,019,707 | A | 11/1935 | Jenkins |
| 2,069,176 | A | 1/1937 | Budd |
| 2,100,957 | A | 11/1937 | Hoffman |
| 2,164,681 | A | 7/1939 | Fould |
| 2,194,113 | A | 3/1940 | Covell et al. |
| 2,231,065 | A | 2/1941 | Gabel |
| 2,847,099 | A | 8/1958 | Gruber |
| 3,017,672 | A | 1/1962 | Vaughan |
| 3,110,371 | A | 11/1963 | De Ridder |
| 3,127,960 | A | 4/1964 | Smith et al. |
| 3,160,280 | A | 12/1964 | Burch |
| 3,216,538 | A | 11/1965 | Miller |
| 3,234,697 | A | 2/1966 | Toti et al. |
| 3,308,596 | A | 3/1967 | Copper et al. |
| 3,377,759 | A | 4/1968 | Booth |

(List continued on next page.)

FOREIGN PATENT DOCUMENTS

| | | |
|---|---|---|
| AT | 396 379 | 8/1993 |
| AU | 26422/77 | 1/1980 |
| AU | B-46098/97 | 3/1998 |
| DE | 984130 | 2/1965 |
| DE | 40 40 215 | 6/1992 |
| WO | WO 92/01129 | 1/1992 |
| WO | PCT/AU99/00765 | 9/1998 |
| WO | WO 00/15917 | 3/2000 |

OTHER PUBLICATIONS

Everlock System, Inc., "Everlock Deluxe Solid Vinyl Skirting," website product description, Oct. 2, 2000.

International Search Report in PCT/US02/25545 dated Nov. 7, 2002.

*Primary Examiner*—Carl D. Friedman
*Assistant Examiner*—Kevin McDermott
(74) *Attorney, Agent, or Firm*—Carter, Deluca, Farrell & Schmidt, LLP

(57) ABSTRACT

A wall panel for a storage building is provided. The wall panel includes a first arcuate ridged region bounded by a first inner clamping surface, and a second inner clamping surface. The wall panel also includes a second arcuate ridged region bounded by a first outer clamping surface and a second outer clamping surface. The second arcuate ridged region of a first wall panel is adapted to securely overlap and snap-fit interconnect with said first arcuate ridged region of a second adjacent wall panel.

25 Claims, 20 Drawing Sheets

U.S. PATENT DOCUMENTS 3,394,524 A 7/1968 Howarth
3,452,501 A 7/1969 Zimmer et al.
3,474,583 A 10/1969 Manias
3,495,363 A 2/1970 Johnson
3,524,292 A 8/1970 Bottom
3,568,388 A 3/1971 Flachbarth et al.
3,606,718 A 9/1971 Curran
3,606,720 A 9/1971 Cookson
3,657,849 A 4/1972 Garton
3,733,767 A 5/1973 Craik
3,812,636 A 5/1974 Albrecht et al.
3,827,201 A 8/1974 Struben
3,832,813 A 9/1974 Hindman
3,834,109 A 9/1974 Iacona
3,852,929 A 12/1974 Cookson
3,968,603 A 7/1976 Merson
4,043,088 A 8/1977 Payton
4,091,588 A 5/1978 Heirich
4,109,437 A 8/1978 Player et al.
4,192,117 A 3/1980 Heirich
4,223,503 A 9/1980 Hague
4,266,385 A 5/1981 Oehlert
4,285,182 A 8/1981 Dinges
4,295,316 A 10/1981 Carlson
4,352,261 A 10/1982 Wargo
4,400,919 A 8/1983 Szabo et al.
4,400,922 A 8/1983 Boyer
4,406,106 A 9/1983 Dinges
4,466,224 A 8/1984 Hague
4,467,582 A 8/1984 Hague
4,486,998 A 12/1984 Hague
4,549,378 A 10/1985 Ayers et al.
4,759,159 A 7/1988 Blazley
4,759,165 A 7/1988 Getoor et al.
4,819,398 A 4/1989 Dameron
4,878,331 A 11/1989 Taylor
4,918,898 A 4/1990 McLeod, Jr.
4,926,608 A 5/1990 Beauregard
5,165,213 A 11/1992 Finch et al.
5,201,158 A 4/1993 Bayley et al.
5,247,772 A 9/1993 Greenberg
5,619,837 A 4/1997 DiSanto
5,692,352 A 12/1997 Simpson
5,737,894 A 4/1998 Simpson et al.
5,752,355 A 5/1998 Sahramaa
5,799,461 A 9/1998 Dittemore
5,881,501 A 3/1999 Guffey et al.
5,907,933 A 6/1999 Stanfill
5,927,028 A 7/1999 Rossi
6,076,328 A 6/2000 Danhof et al.
6,088,983 A 7/2000 Applebee

SNAP-FIT PANEL CONNECTION APPARATUS

TECHNICAL FIELD

The present invention relates generally to building structures and, more particularly, to storage building structures and an apparatus for connecting load bearing members for storage building structures.

BACKGROUND OF THE INVENTION

Prefabricated buildings, such as storage buildings or sheds, are intended to be purchased, assembled, and maintained by consumers who do not necessarily have the training or inclination to assemble and maintain such a structure, particularly if such assembly and/or maintenance requires a great deal of skill. Accordingly, prefabricated metal storage buildings have been developed that include pre-punched fastener holes and other design features that simplify the assembly of such a storage building. However, such designs typically require a large number of threaded fasteners (e.g., 600 or more threaded fasteners), such as screws and bolts, for a typical storage building having a length of about eight feet (about 2.4 meters) and a width of about ten feet (about 3.0 meters). This large number of threaded fasteners causes the assembly, maintenance and disassembly of a storage building to be a time consuming and tedious task, especially for the typical consumer who is not accustomed to assembling storage buildings. Assembly could be simplified by providing only a few but relatively large portions of the storage building to the ultimate purchaser. For example, each portion could comprise either an integral or preassembled major component (such as an entire wall). However, such an approach is inconsistent with the need to package the unassembled storage building in a relatively small shipping container to enable the consumer to easily transport it from the place of purchase to the site on which the storage building is to be erected. Further, preassembly of numerous separate components involves additional labor, increasing the overall cost of the storage building.

In addition, the large number of threaded fasteners, associated holes and inevitable nicks and scratches that occur during installation of the fasteners provide a large number of locations that can be undesirably prone to corrosion.

Accordingly, efforts have been made to design storage buildings that may be assembled with a substantial reduction in the required number of threaded fasteners and/or rivets.

For example, Australian Petty Patent No. AU-B-46098/97 discloses a storage building structure that includes corrugated panels, made from sheet steel, and edge channels for attachment to upper and lower ends of the corrugated panels. The edge channels are formed from rolled sheet steel. Each corrugated panel includes punched lugs adjacent the upper and lower edges thereof while the edge channels include projections engaged by the punched lugs in the corrugated panels in order to lock the corrugated panels to the edge channels.

Another example of a storage building structure with reduced reliance on fasteners is shown in PCT published application No. PCT/AU99/00765, which discloses a clip fastening system for attaching a wall panel to a frame rail using a clip. The clip is fitted to the frame rail and has pawl-like tabs which locate in apertures in a side wall of the frame rail. Corresponding apertures on the edge of the wall panels permit the pawl-like tabs to snap fit through the apertures and retain the wall panel to the frame rail. In an alternative embodiment, the clip is formed integrally with the frame rail by pressing out a flap from a side wall of the frame rail, each flap including a pawl-like indent.

Yet another example of a storage building that uses a reduced number of threaded fasteners is shown in Danhof et al., U.S. Pat. No. 6,076,328 ("the '328 patent"), which is assigned to the assignee of the present invention. The '328 patent discloses an apparatus that uses slotted horizontal frame members sized and spaced to accept ends of vertical support members. The apparatus also includes a panel connection configuration utilizing U-shaped vertical edges of wall panels that are adapted to hook onto edges of vertical support members, and that are locked in place using a clip member.

SUMMARY OF THE INVENTION

In accordance with one aspect of the invention, a wall panel for a storage building is provided. The wall panel includes: a first arcuate ridged region bounded by a first inner clamping surface, and a second inner clamping surface; and a second arcuate ridged region bounded by a first outer clamping surface and a second outer clamping surface. The second arcuate ridged region is adapted to securely overlap and snap fit interconnect with the first arcuate ridged region of a second adjacent wall panel.

In accordance with another aspect of the invention, the wall panel has an upper edge and a lower edge, and the first and second arcuate ridged regions extend from the upper edge to the lower edge.

In accordance with yet another aspect of the invention, the first and second arcuate regions each include slots, for example, rectangular slots, located adjacent to the upper edge and the lower edge. The slots may extend in a direction substantially parallel to the upper and lower edges.

In accordance with a still further aspect of the invention, the wall panel further includes a first web portion forming approximately a 270° angle with the first inner clamping surface.

In accordance with another aspect of the invention, the wall panel further includes a second web portion forming approximately a 275° angle with the second outer clamping surface In accordance with still another aspect of the invention, a storage building includes: a plurality of wall panels, each wall panel including a first arcuate ridged region bounded by a first inner clamping surface, and a second inner clamping surface. Each wall panel further includes a second arcuate ridged region bounded by a first outer clamping surface and a second outer clamping surface. The second arcuate ridged region is adapted to securely overlap with the first arcuate ridged region of an adjacent wall panel.

In accordance with yet another aspect of the invention, a storage building comprises a plurality of wall panels and a plurality of channel-shaped horizontal elongate structural members. Each wall panel includes a first arcuate ridged region bounded by a first inner clamping surface, and a second inner clamping surface. Each wall panel further includes a second arcuate ridged region bounded by a first outer clamping surface and a second outer clamping surface. The second arcuate ridged region is adapted to securely overlap with the first arcuate ridged region of an adjacent wall panel to form a pair of overlapped wall panels, and the overlapped wall panels are adapted to be received by at least one of the channel-shaped horizontal elongate structural members.

BRIEF DESCRIPTION OF THE DRAWINGS

These and other features of the present invention will be more clearly understood from a consideration of the following description taken in connection with the accompanying drawings, in which.

DETAILED DESCRIPTION OF THE INVENTION

Figure 1:
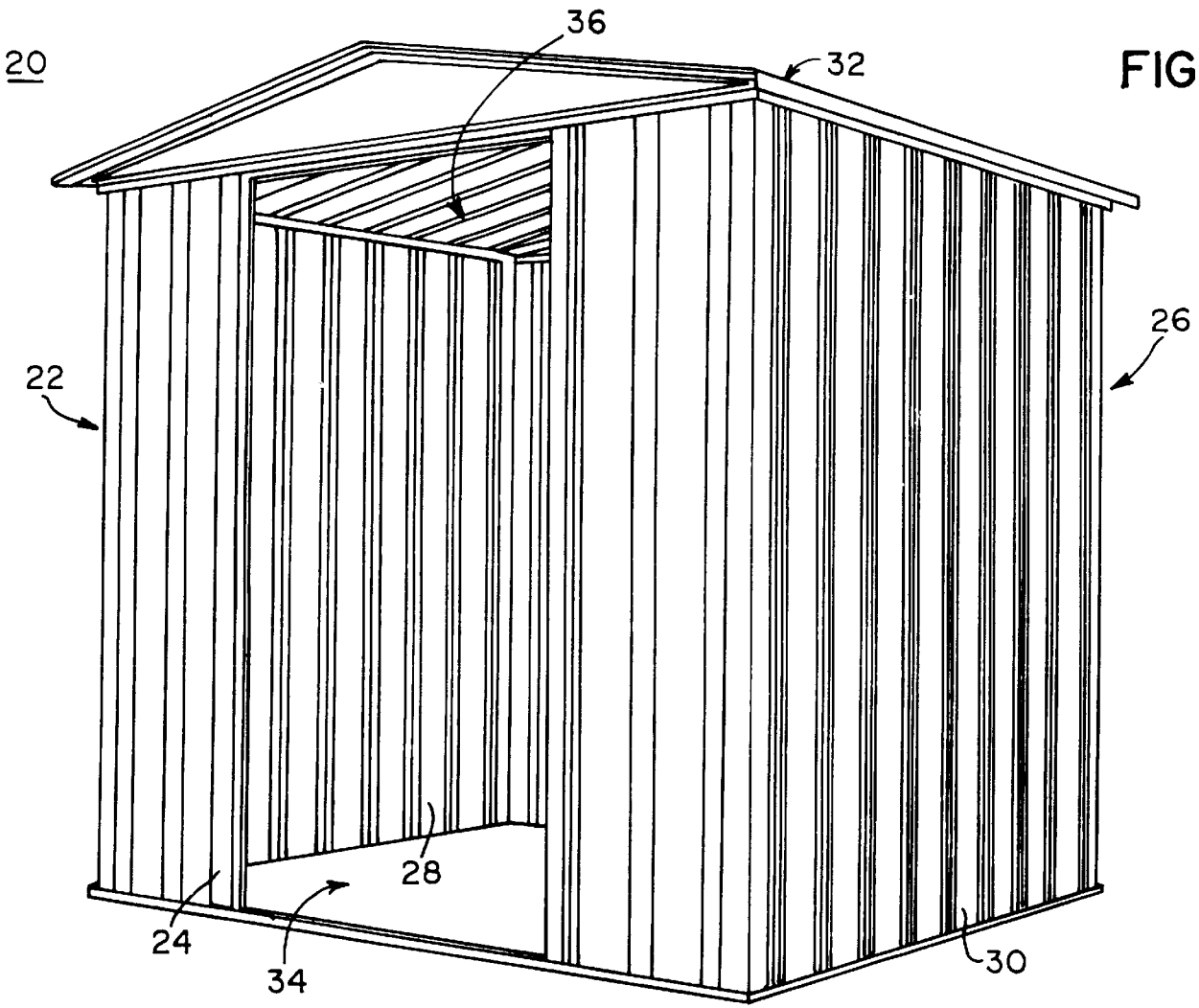
FIG. 1 is an isometric view of a storage building constructed in accordance with the present invention.

Referring to FIG. 1, an exemplary storage building 20 has a rectangular frame 22 with opposing front and back, right and left walls, 24, 26, 28, 30, respectively. The storage building 20 also includes a roof 32. The front and back, right and left, walls 24, 26, 28, 30 and the roof 32 define an interior space 34. The front wall 24 defines an opening 36 there through which provides access to the interior space 34. A door (not shown) may be attached to the front wall 24 at the opening 36. The door may by hinged or mounted in order to swing or slide open and closed.

Figure 2:
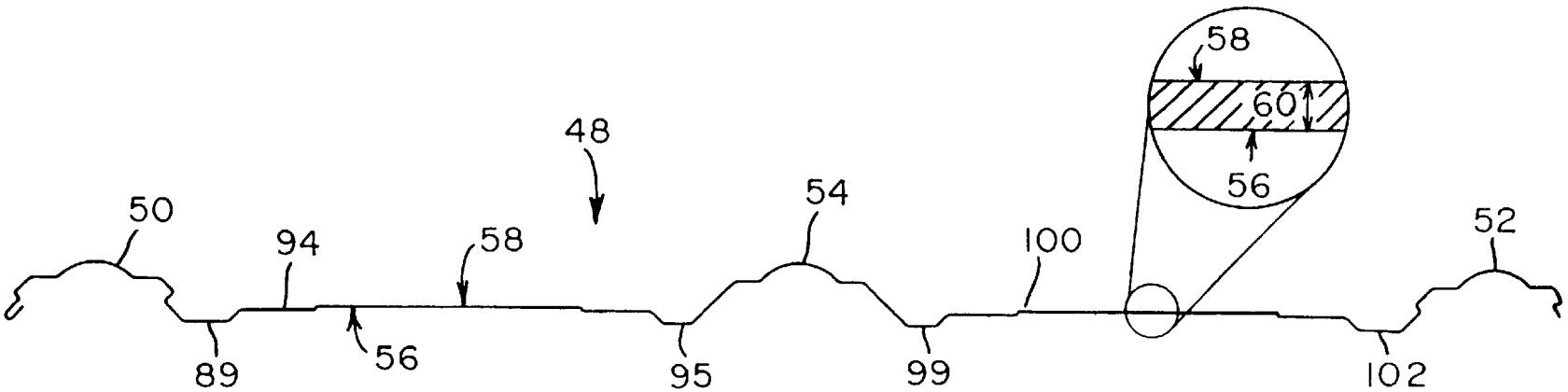
FIG. 2 is top view of a standard wall panel in accordance with the present invention.

Referring now to FIG. 2, there is depicted a standard snap-fit panel 48 in accordance with the present invention. The roof 32, right wall 28, left wall 30 and back wall 26 are constructed of a plurality of snap fit standard snap-fit panels 48. The standard snap-fit panel 48 includes a first and a second ridged end portion 50, 52. In addition to the first and second ridged end portions 50, 52, the standard snap-fit panel 48 further includes at least one middle ridged portion 54. The middle ridged portion 54 is disposed between the first and second ridged end portion 50, 52. Additionally, the middle ridged portion 54 is formed to be equidistant from the first and second ridged end portions 50, 52. Standard snap-fit panels 48 are made of a continuous piece of material such as sheet metal or plastic with several bent up or otherwise formed contours. Additionally, the standard snap-fit panels 48 include an inner and outer surface 56, 58. The inner and outer surfaces 56, 58 define a thickness 60 of the standard snap-fit panel 48. Thickness 60 is substantially constant throughout the standard snap-fit panel 48. For example, if the standard snap-fit panel 48 is constructed from steel, the thickness 60 of approximately 0.22 mm may be used.

Figure 3:
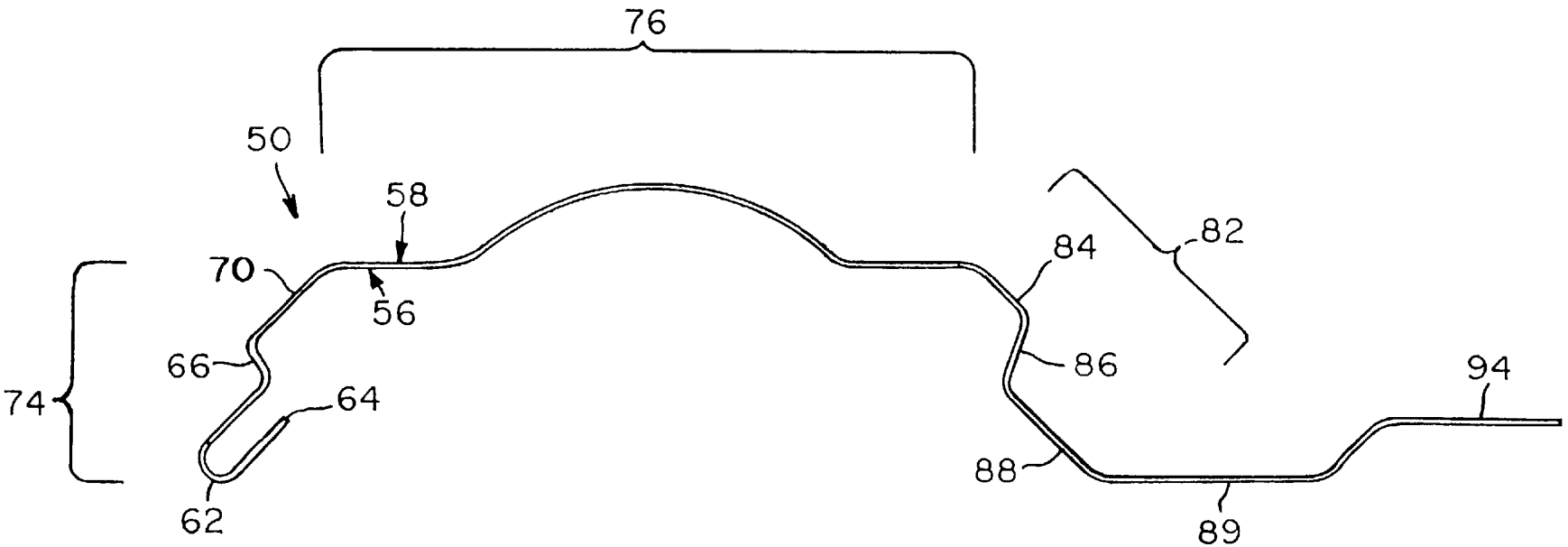
FIG. 3 is a detailed enlarged top view of a first ridged end portion of the panel of FIG. 2.

As best seen in FIG. 3, the first ridged end portion 50 also includes a first U-shaped portion 62 that terminates in a first standard snap-fit panel edge 64. Directly adjacent the first U-shaped portion 62, is a first clamping portion 66. The outer side 58 of the first clamping portion 66 forms approximately a 90° angle with the outer surface of the first U-shaped edge portion 62. Additionally, a first web portion 70, is adjacent the first clamping portion 66 of the first ridged end portion 50. The outer surface 58 of the first web portion 70 forms approximately a 270° angle with the outer surface 58 of the first clamping portion 66. The outer surface 58 of the first U-shaped portion 62, the first clamping portion 66, and the first web portion 70 combine to form a first engaging portion 74.

Adjacent to the first engaging portion 74 is the first end arcuate portion 76. Portion 76 may be formed with a variety of different contoured shapes. These contoured shapes work to provide an aesthetically pleasing surface appearance to the exterior surface 58 of standard snap-fit panel 48. Moreover, these contoured shapes work to add stability to the standard snap-fit panel 48, and therefore rigidity to the building 20 made therefrom. As such, the majority of the length of each of the first end arcuate portion 76, second end arcuate portion 78, and even middle arcuate portion 80 are substantially similar to one another. (Compare FIGS. 2–5).

Referring again to FIG. 3 and the first ridged end portion 50, note that adjacent to the first end arcuate portion 76 and opposite the first engaging portion 74, is a second engaging portion 82. Portion 82 is comprised of a second web portion 84, a second clamping portion 86 and a first connecting member 88. The outer surface 58 of the second web portion 84 forms approximately a 275° angle with the outer surface 58 of the second clamping portion 86. The outer surface 58 of the second clamping portion 86 forms approximately a 85° angle with the outer surface 58 of the first connecting member 88. As better seen in FIG. 2, a transition member 89 of the first ridged end portion 50 attaches the second engaging portion 82 of the first ridged end portion 50 to the first substantially flat portion 94. Adjacent to the first substantially flat portion 94 and opposite the first connecting member 88, is the middle ridged portion 54 (See FIG. 2).

Figure 4:
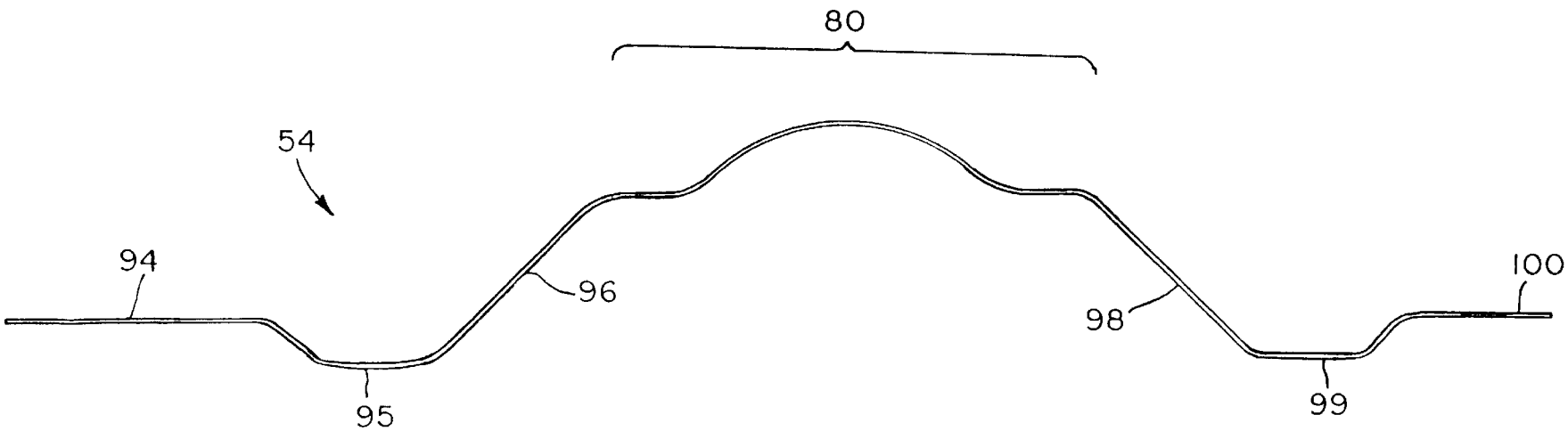
FIG. 4 is a detailed enlarged top view of a middle ridged portion of the panel of FIG. 2.

Referring now to FIG. 4, the middle ridged portion 54 includes a first middle transition member 95 which connects the first substantially flat portion 94 to a first middle connecting member 96. Member 96 attaches the first middle transition member 95 to the middle arcuate section 80. Adjacent middle arcuate section 80 is a second middle connecting portion 98. Portion 98 connects the middle arcuate portion 80 to the second middle transition member 99. Member 99 in turn connects the middle ridged end portion 54 to a second substantially flat portion 100.

Figure 5:
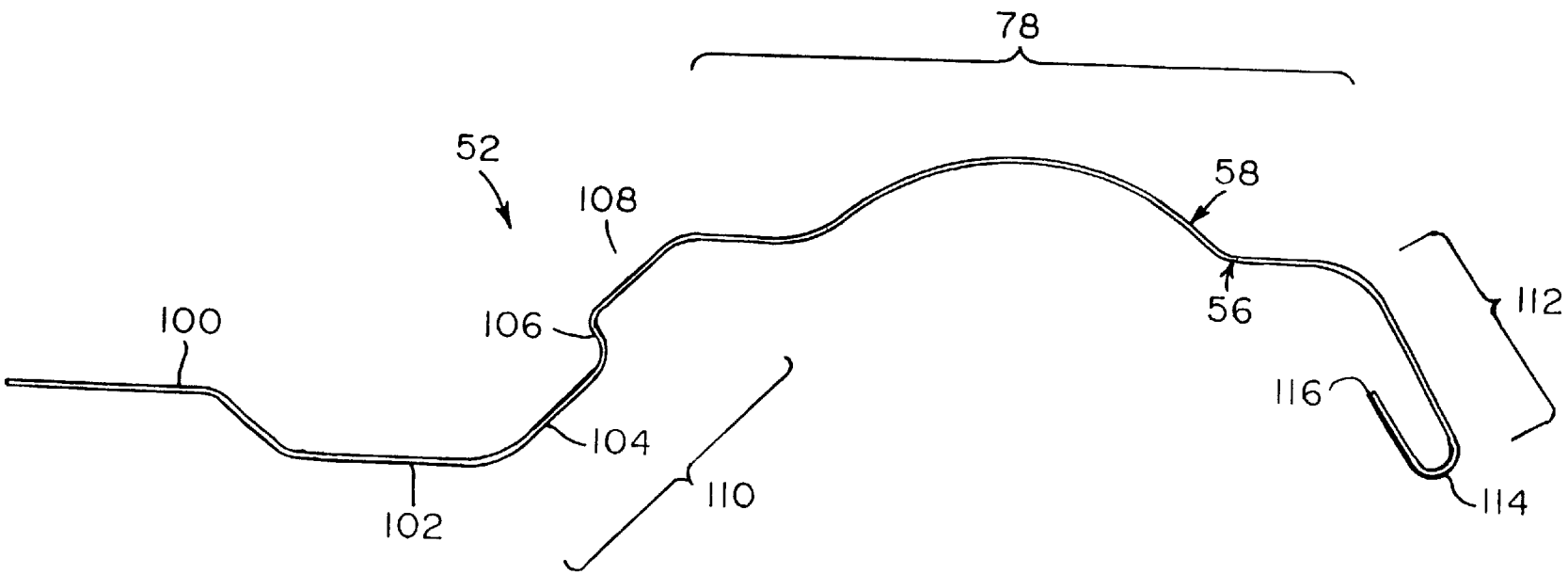
FIG. 5 is a detailed enlarged top view of a second ridged end portion of the panel of FIG. 2.

Referring now to FIG. 5, the second substantially flat portion 100 attaches to a transition portion 102 of the second ridged end portion 52. This transition portion 102 connects the second substantially flat portion 100 to a second connecting member 104. Immediately adjacent the second connecting member 104 is a third clamping portion 106. The inner surface 56 of the second connecting member 104 is approximately 270° from the inner surface 56 of the third clamping portion 106. Formed at approximately 90° from the inner surface 56 of the third clamping portion 106, and opposite the second connecting member 104, is a third web portion 108. The inner surfaces 56 of the second connecting member 104, the third clamping portion 106 and third web portion 108 combine to form a first engaging portion 110 of the second ridged end portion 52. Adjacent first engaging portion 110 is the second end arcuate portion 78. As seen, the majority of the length of portion 78 is substantially similar in shape and contour as such lengths of the first end arcuate portion 76 and the middle arcuate portion 80. Adjacent the second end arcuate portion 78 is a second engaging portion 112 of the second ridged end portion 52. Second engaging portion 112 includes a second U-shaped edge portion 114, which portion, in turn, terminates in a second panel edge 116.

Figure 6A:
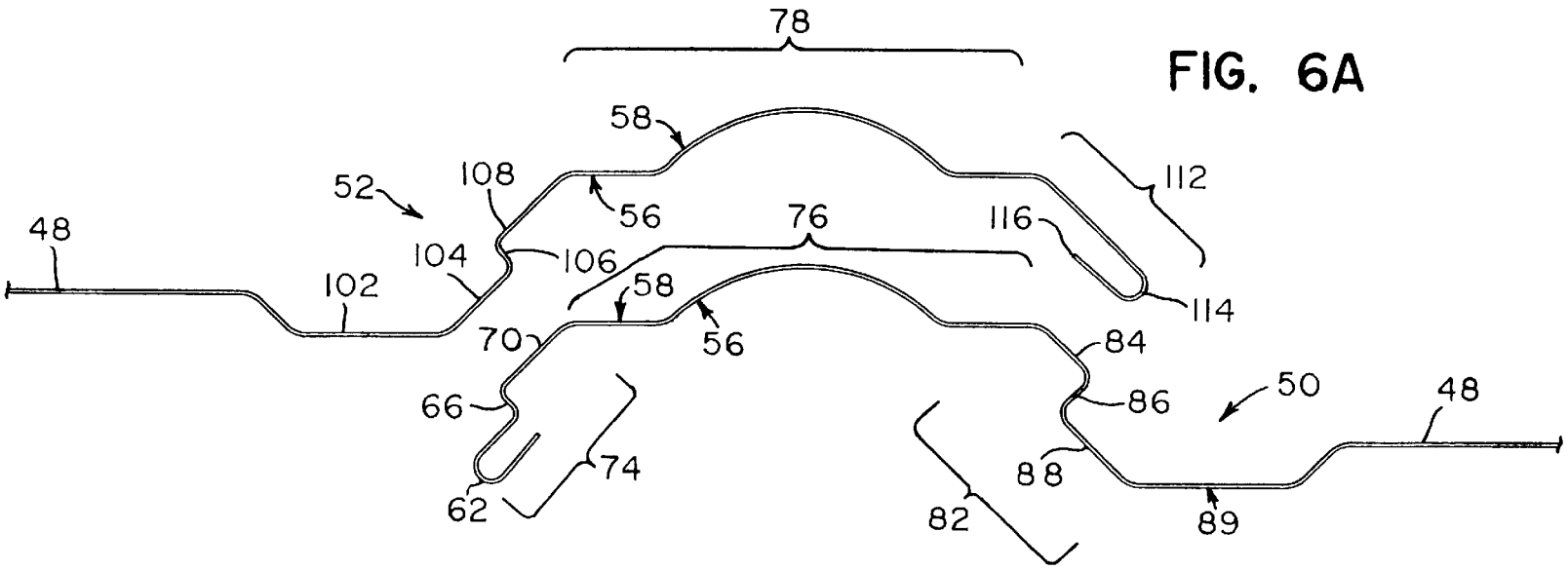
FIG. 6*a* is an enlarged top view of a first and second ridged end portion in proximity to one another.
Figure 6B:
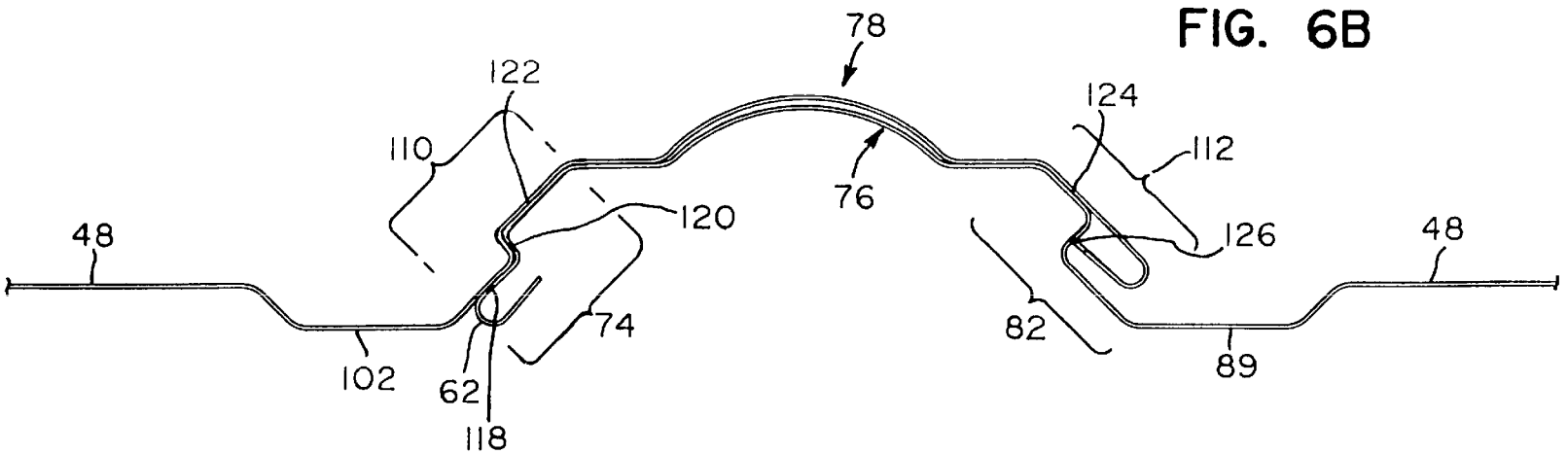
FIG. 6*b* is a top view of a first and second ridged end portion nestably engaged to one another.

Turning now to FIGS. 6*a* and 6*b,* the first ridged end portion 50 of a standard snap-fit panel 48 and the second ridged end portion 52 of another adjacent standard snap-fit panel 48 are adapted to securely engage one another, i.e. nestably lock together, without the need for fasteners, such as screws, rivets, or bolts, that might otherwise be needed to secure adjacent panels to one another in the absence of such a snap-fit configuration. The inner surface 56 of the second ridged end portion 52 securely snaps in a fiction fit manner over the outer surface 58 of the first ridged end portion 50. As seen in FIG. 6*b,* the first engaging portion 74 of the first ridged end portion 50 engages to the first engaging portion 110 of the second ridged end portion 52. As such, the outer surface 58 of the first U-shaped portion 62 directly engages the inner surface 56 of the second connecting member 104. At the location where the first U-shaped portion 62 engages the second connecting member 104 is formed a first interface 118. Similarly, second interface 120 is formed from the engagement of the outer surface 58 of the first clamping portion 66 and the inner surface 56 of the third clamping portion 106. Moreover, a third interface 122 is formed by the engaging of the inner surface 56 of the third web portion 108 and the outer surface 58 of the first web portion 70. Furthermore, a fourth interface 124 is formed where the inner surface 56 of the second U-shaped edge portion 114 engages the outer surface 58 of the second web portion 84. Still further, a fifth interface 126 is formed at the second panel edge 116 and the second clamping portion 86. Although not an engaging interface, as seen in FIG. 6*b,* the inner surface 56 of the second end arcuate portion 78 (of a first panel 48) substantially follows the outer surface 58 of the first end arcuate portion 76, when the first ridged end portion 50 engages the second ridged end portion 52 of a second, adjacent snap-fit panel 48.

Figure 7A:
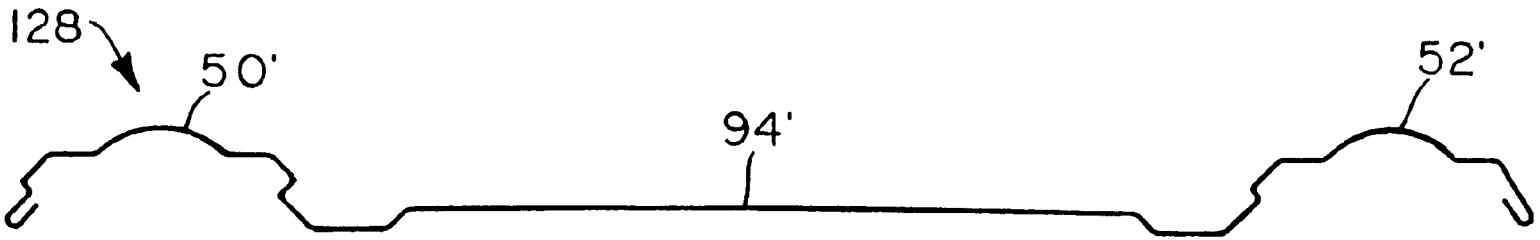
FIG. 7*a* is a top view of an alternate, narrow panel embodiment in accordance with the present invention.
Figure 7B:
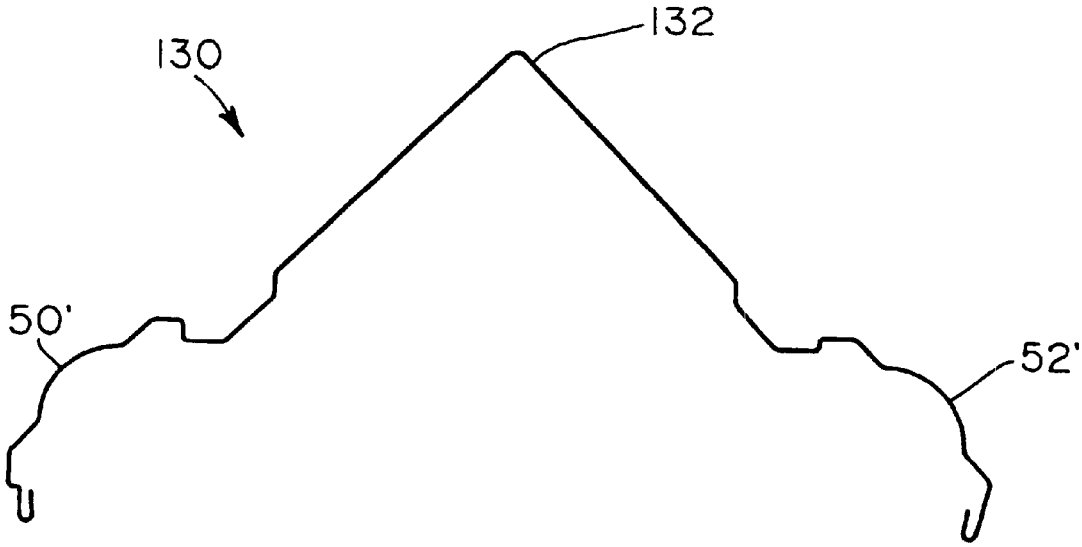
FIG. 7*b* is a top view of an alternate, corner panel embodiment in accordance with the present invention.

FIGS. 7*a* and 7*b* show alternative embodiments of the standard snap-fit panel 48. (Hereafter, portions of the embodiments found in FIGS. 7*a* and 7*b* that are identical to previously described portions shall be indicated with the same reference number with the addition of a prime.) First, FIG. 7*a* shows a narrow panel 128. This panel is identical to the standard snap-fit panel 48 except that it does not include a middle ridged portion 54 and a second substantially flat portion 100. As seen in FIG. 7*a,* the narrow panel 128 includes a first ridged end portion 50', a second ridged end portion 52' and first substantially flat portion 94'. The shorter overall width of panel 128, contrasted to that of panel 48, is beneficial when a given building length demands less than a full panel 48.

Then, FIG. 7*b* depicts a corner panel 130. The corner panel 130 is similar to the narrow panel 128 in that it does not contain a middle ridged portion 54 or a second substantially flat portion 100. As such, the corner panel 130 includes a first ridged end portion 50' and a second ridged end portion 52'. However, the first substantially flat portion 94' that is found in narrow panel 128 is not present in the corner panel 130. Instead, the corner panel 130 contains a bent portion 132 that is disposed between the first ridged end portion 50' and the second ridged end portion 52'.

Figure 8:
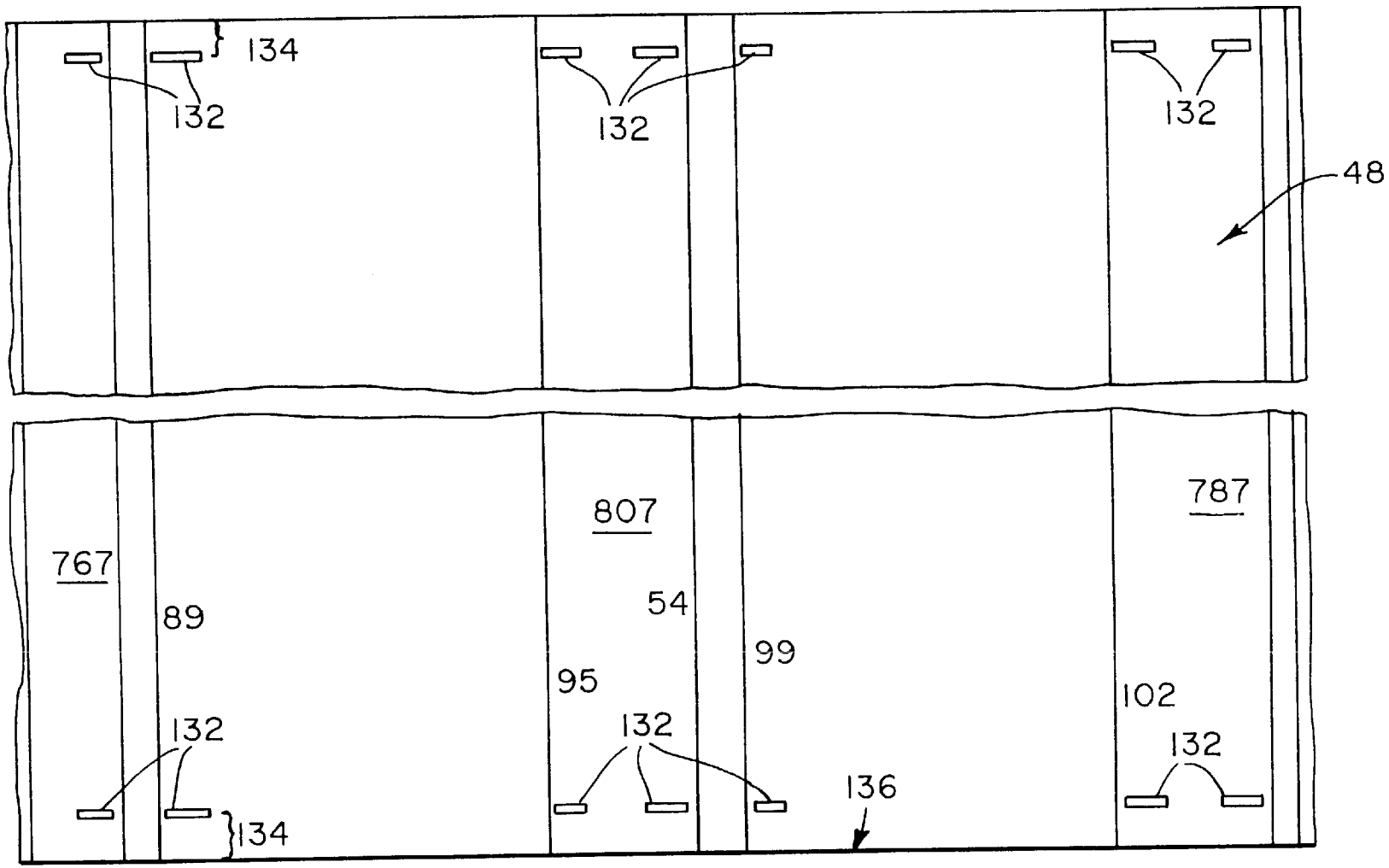
FIG. 8 is a front elevation view of a standard panel in accordance with the present invention.

FIG. 8 depicts a front elevation view of the lower portion of a standard snap-fit panel 48. From this view, several apertures 132 can be seen. These apertures 132 are generally rectangular in shape, and are located at a predetermined distance 134 from the bottom edge 136 and similarly from the top edge 138, of the standard snap-fit panel 48. Specifically, apertures 132 can be found in first end arcuate portion 76, and in the first transition member 89 of the first ridged end portion 50. Moreover, centrally-located such apertures 132 can also be found in the first and second middle transition members 95, 99, and the middle arcuate portion 80 of the middle ridged portion 54. Furthermore, the apertures can be found in the second transition member 102 and the second end arcuate portion 78 of the second ridged end portion 52. Still further, with respect to the narrow panel 128 and corner panel 130, the apertures 132 are also found at predetermined distance 134 from the top and bottom edges (not shown). The apertures 132 as formed in the narrow panel 128 and corner panel 130 embodiments are located in the same places as with the standard snap-fit panel 48, with the exception, of course, that there are no apertures 132 formed in the middle ridged portion 54, namely, because panels 128, 130 do not have such a middle ridged portion 54.

Figure 9:
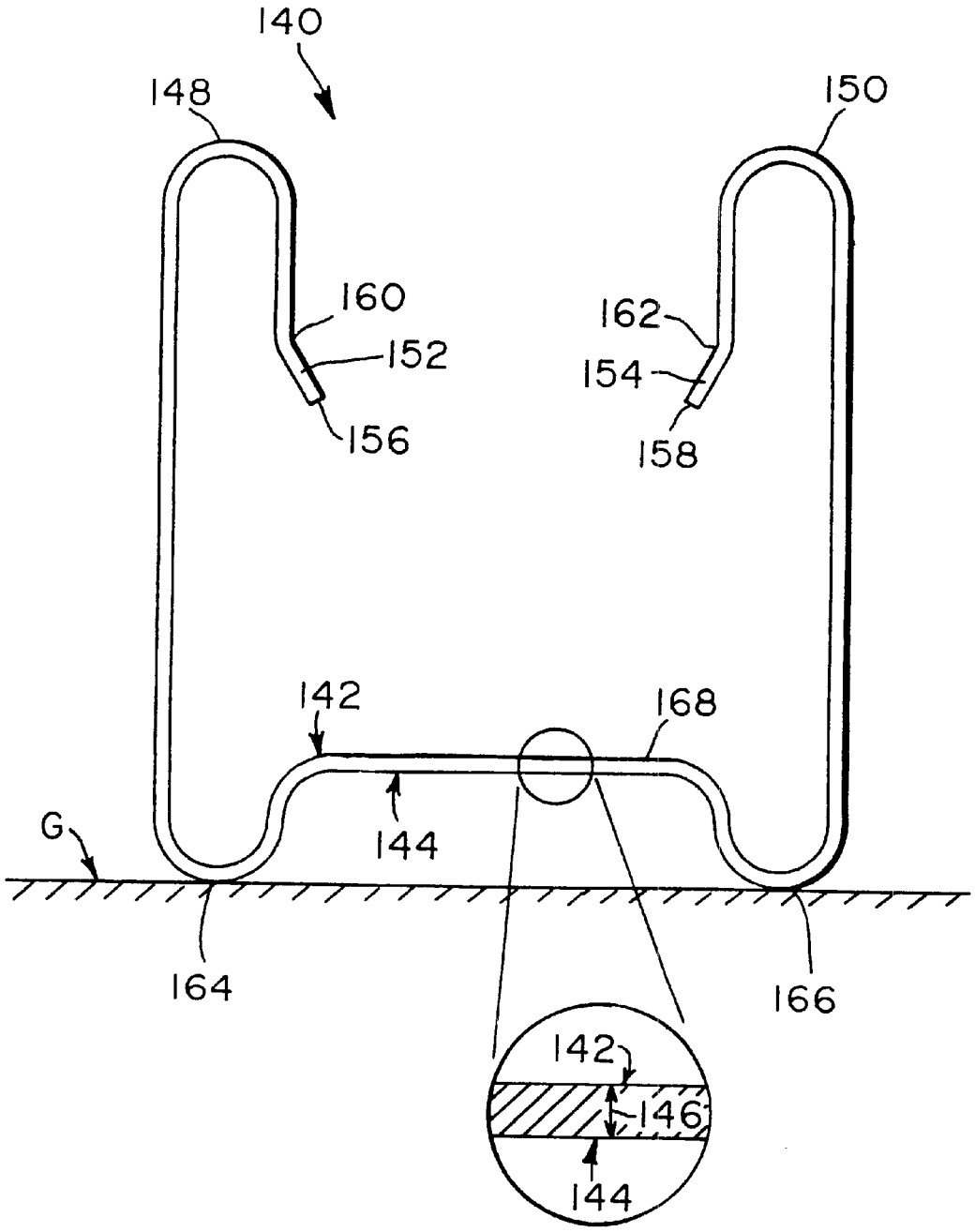
FIG. 9 is a detailed enlarged end view of a panel channel in accordance with the present invention.

FIG. 9 generally depicts an enlarged end view looking along the length of a panel channel 140. Channel 140 is designed to fit over the respective top edges 138, and the respective bottom edges 136 of the standard snap-fit panels 48, once the same have been snap-fit together in end-to-end fashion as described above. Additionally, the corner panel embodiment 130 and the narrow panel embodiment 128 also fit with the panel channel 140. As best seen in FIGS. 9–11*b,* the panel channel 140 is a continuous piece of material such as sheet metal or plastic that includes an inside surface 142 and an outside surface 144. The inside and outside surfaces 142, 144 define a thickness 146 of the panel channel 140. For example, if the panel channel 140 is constructed from steel, a thickness 146 of about 0.43 mm may be used. The panel channel 140 further includes a first and second inwardly-turned U-shaped portions 148, 150. These U-shaped portions 148, 150 are also formed to contain first and second aperture engaging portions 152, 154. Such aperture engaging portions 152, 154 terminate at first and second panel channel edges 156, 158. The aperture engaging portions 152, 154 further include angled transitions 160, 162. These angled transitions 160, 162 are angled at approximately 45° toward the outside surface 144. Additionally, the panel channel 140 includes a first and second foot portion 164, 166. Such portions 164, 166 are connected to one another by a cross web portion 168. The distance from the inside surface 142 of the web portion 168 to the angled transitions 160, 162, is approximately the same as the predetermined distance 134. Furthermore, cross web portion 168 is formed to sit slightly higher (relative to ground surface G) than the first and second foot portions 164, 166.

Figure 10:
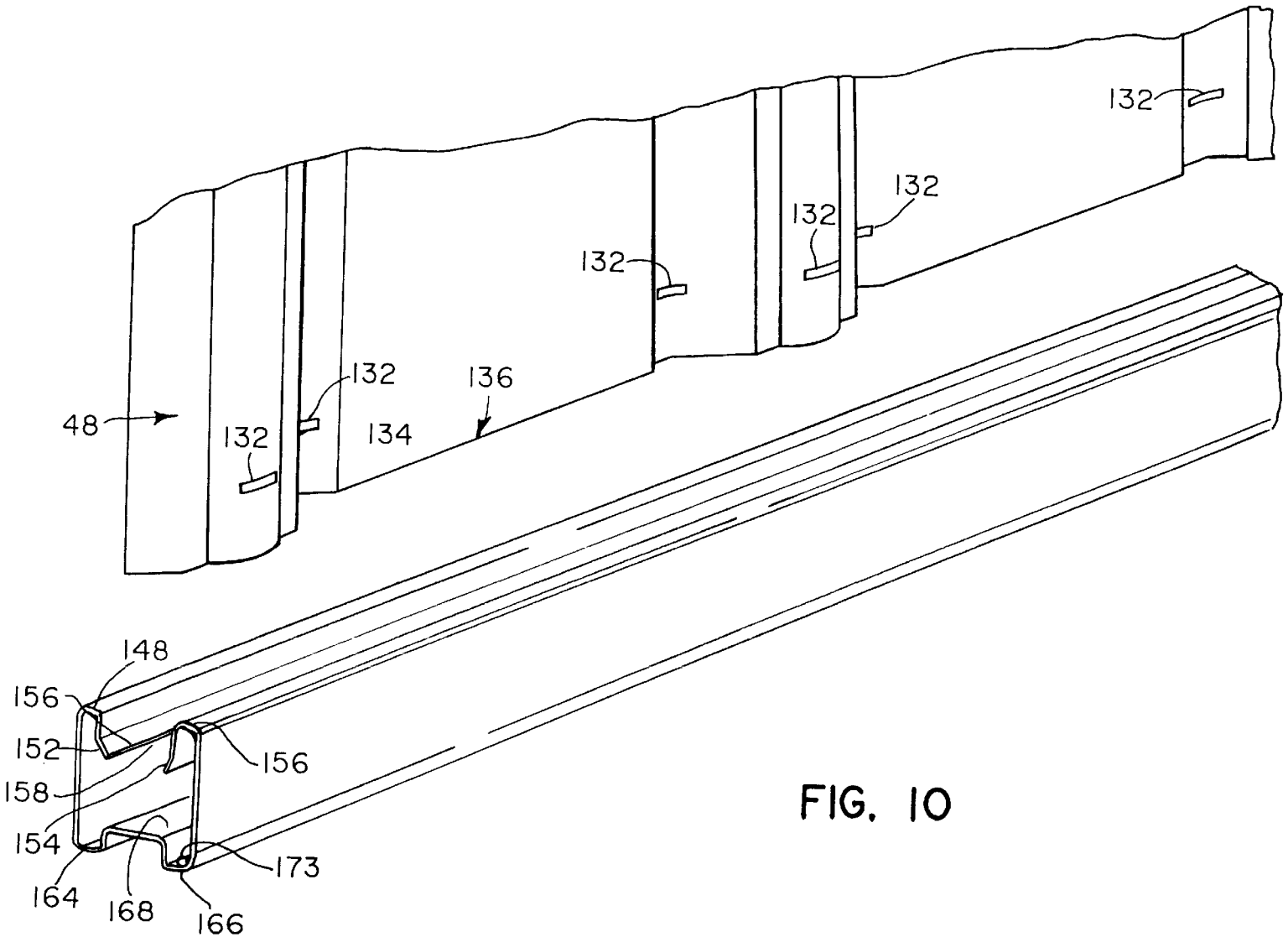
FIG. 10 is a perspective view of a panel about to be engaged with a panel channel in accordance with the present invention.
Figure 11A:
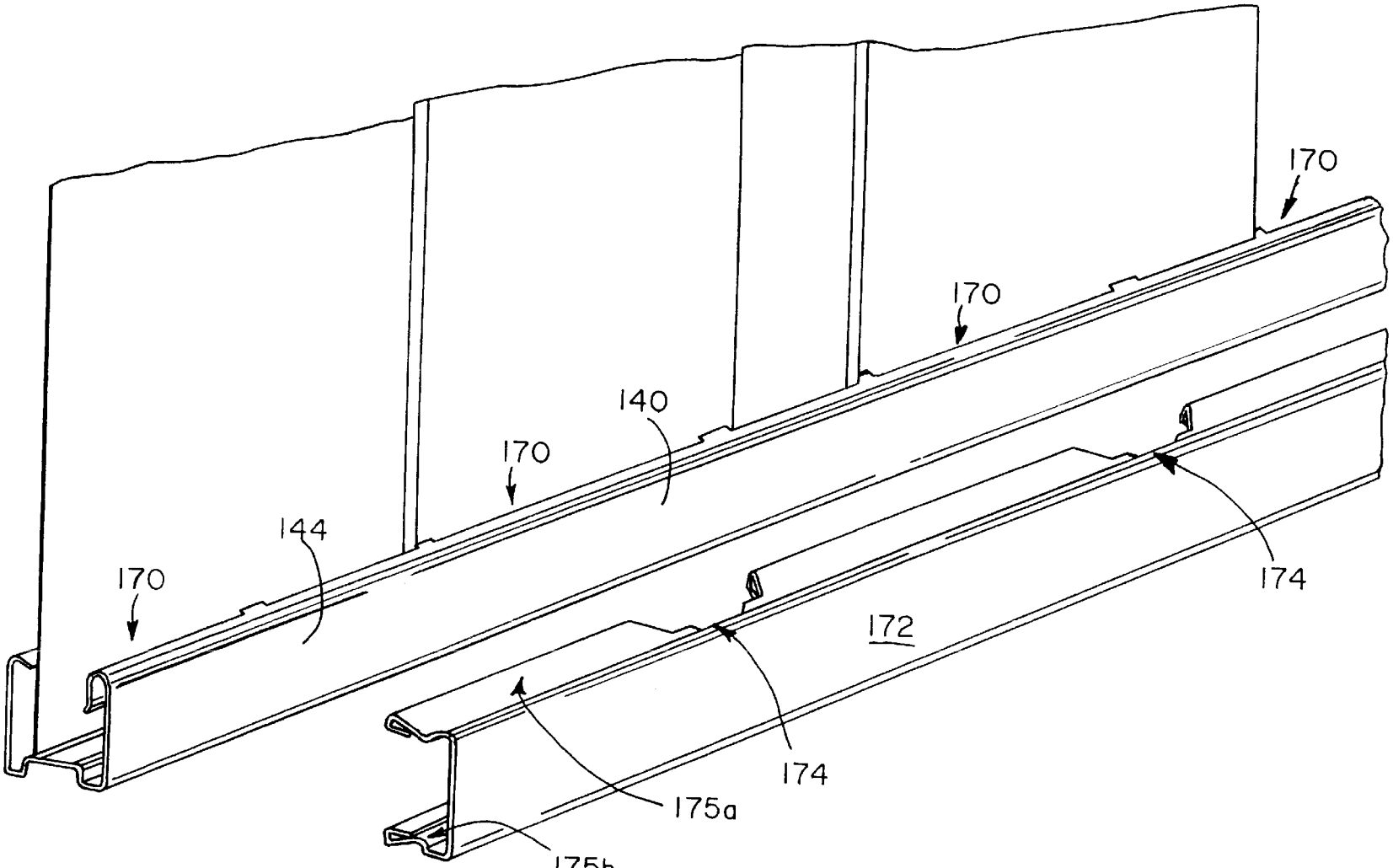
FIG. 11*a* is a perspective view of a panel engaged to a panel channel and a debris deflector about to be engaged therewith in accordance with the present invention.

FIGS. 10 and 11*a* show the method in which the panel channel 140 engages the bottom edge 136 of a standard snap-fit panel 48. The standard snap-fit panel 48 is inserted into the panel channel 140, such that its bottom edge 136 rests on the cross web portion 168. Once the bottom edge 136 is on the web portion 168, the aperture engaging portions 152, 154 of the panel channel 140 engage the apertures 132 of the standard snap-fit panel 48. In this manner the standard snap-fit panels 48 may be secured to the panel channel 140 without the need for separate fasteners, such as screws, rivets, or bolts. Although not shown, the panel channel 140 also engages the lower (and upper) edges 136', 138' of the narrow panel 128 and corner panel 130 embodiments in the same manner as previously-described.

As indicated, the panel channel 140 may engage either the top edge 138 or the bottom edge 136 of a standard snap-fit panel 48. As better seen in FIG. 11*a,* when the panel channel 140 engages the bottom edge 136 of a standard snap-fit panel, there are gaps 170 where there is a distance between the outer surface 58 of the standard snap-fit panel 48 and the first or second panel channel edge 156, 158. Thus, due to the fact that the storage building 20 will generally be located outdoors, it would be desirable to keep debris from collecting in gaps 170. A debris deflector 172 is designed to prevent debris from getting into gaps 170. The debris deflector 172 may be constructed from plastic or sheet metal. For example, if the debris deflector 172 is constructed from steel, it may have a thickness of about 0.43 mm. In addition, drainage holes or slots 173 may be provided in the panel channel 140 to prevent water or other liquids from collecting in the panel channel 140. The debris deflector 172 contains several recesses 174 formed in upper and lower wall segments 175*a,* 175*b* of deflector 172 that follow the contours of the standard snap-fit panel 48. More specifically, the recesses 174 follow the contours of outer surface 58 of the second ridged end portion 52 and the outer surface 58 of the middle ridged portion 54. The recesses 174 allow the debris deflector 172, and especially walls segments 175*a,* 175*b* to fit snugly against to the standard snap-fit panel 48, thereby preventing access to gaps 170 when the debris deflector 172 is snapped onto the outside surface 144 of the panel channel 140. See FIG. 11*b.*

Figure 11B:
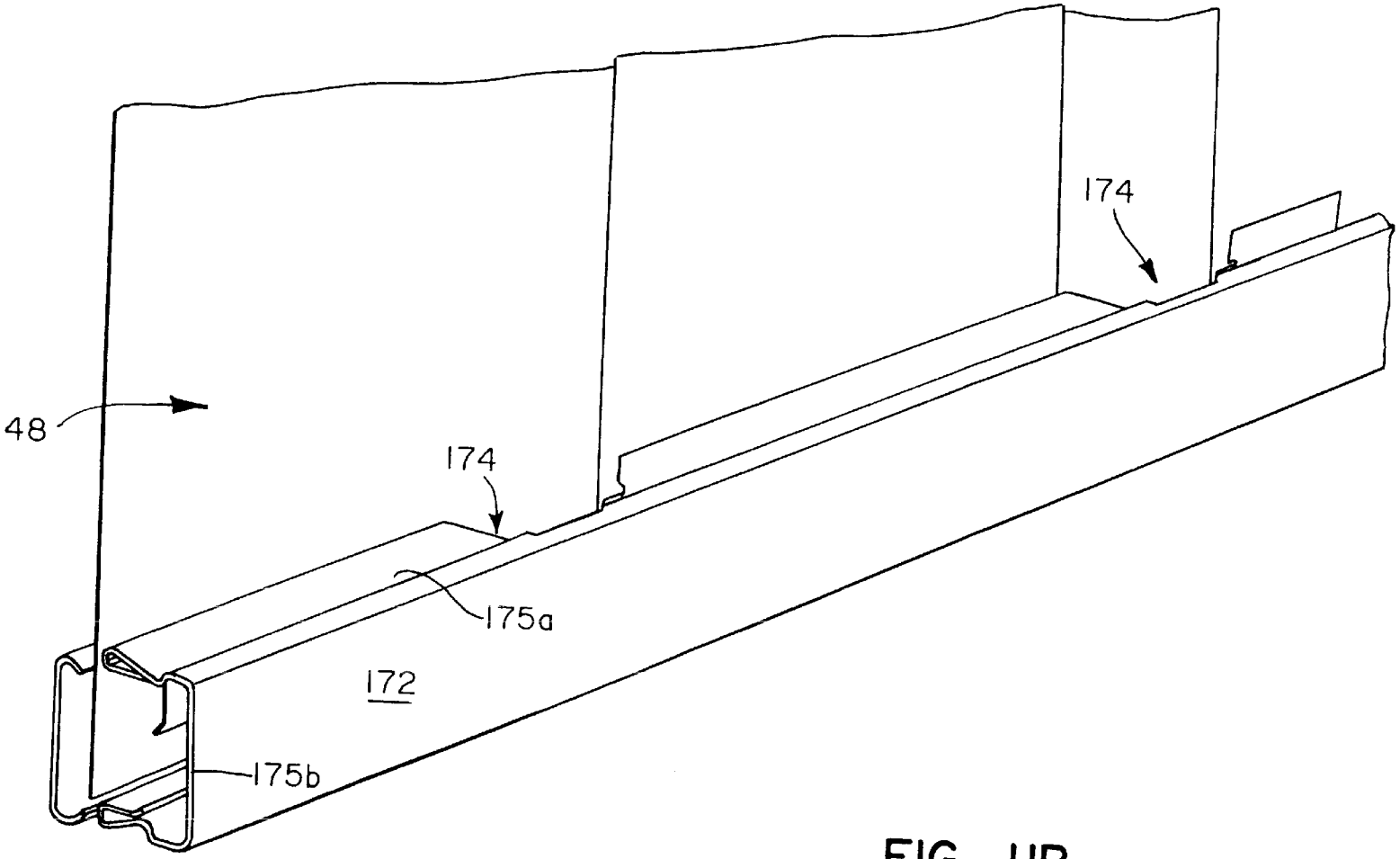
FIG. 11*b* is a perspective view of the engaged combination of a panel, a panel channel, and a debris deflector in accordance with the present invention.
Figure 12:
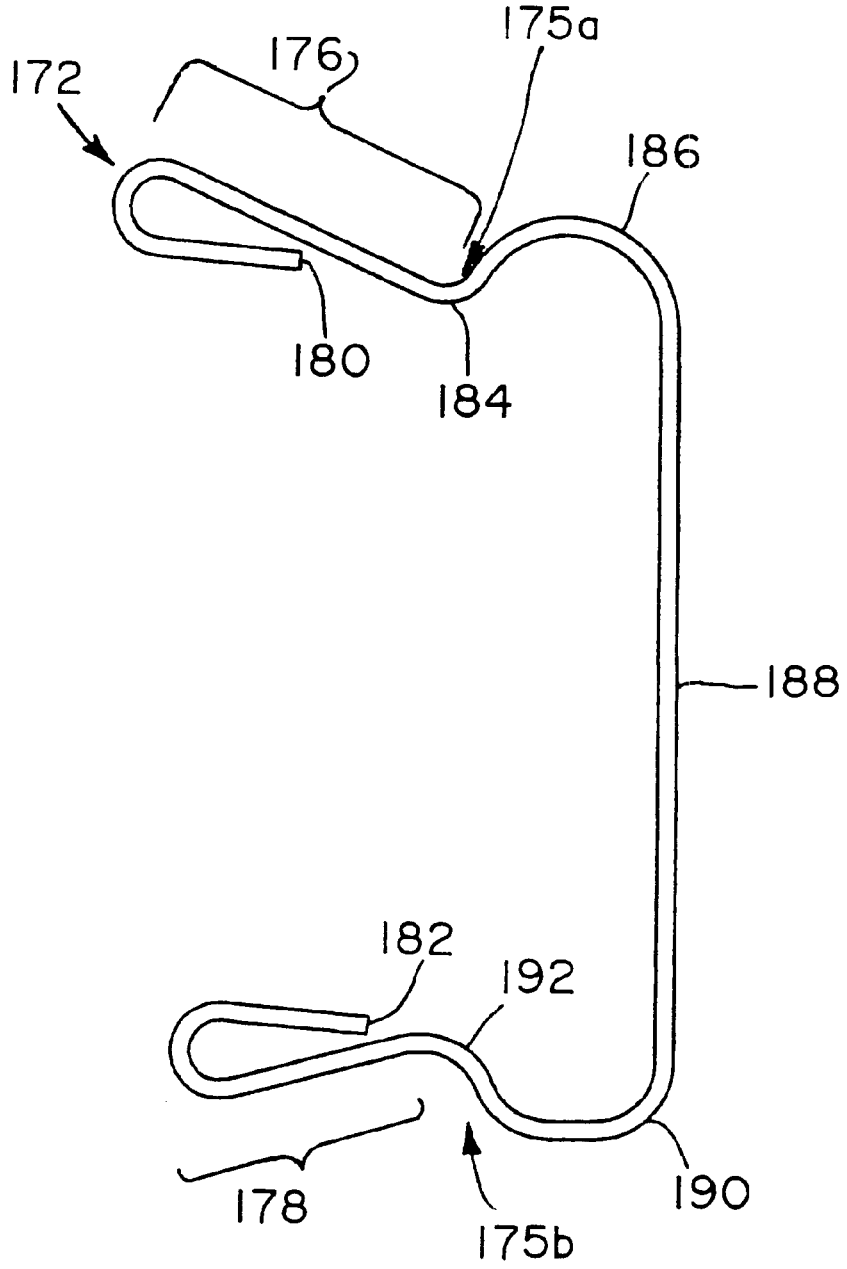
FIG. 12 is a detailed enlarged end view of a debris deflector in accordance with the present invention.

Referring now to FIG. 12, the debris deflector 172 includes an upper and lower hemmed portion 176, 178, formed respectively an upper and lower wall segments 175*a,* 175*b.* The upper hemmed portion 176 terminates in an upper debris deflector edge 180. The lower hemmed portion 178 terminates in a lower debris deflector edge 182. Immediately adjacent the upper hemmed portion 176 is a first transition portion 184. The first transition portion 184 connects the upper hemmed portion 176 to a U-shaped engaging portion 186. It is important to note that the transition portion 184 is formed to be slightly lower than the U-shaped engaging portion 186. This is important in assuring that the debris deflector 172 snaps into place on the panel channel 140. Additionally, the debris deflector also includes a second transition portion 188. The second transition portion 188 travels in a substantially vertical manner and attaches the U-shaped portion 186 to a foot engaging portion 190. Adjacent the foot engaging portion 190 and opposite the second transition portion 188, is a third transition portion 192. This third transition portion 192 which is formed to be slightly higher than the foot engaging portion 190, and attaches the foot engaging portion 192 to the lower hemmed portion 178. As seen in FIGS. 11*a* and 11*b,* the upper hemmed portion 176 contains recesses 174 at regular intervals.

Figure 13:
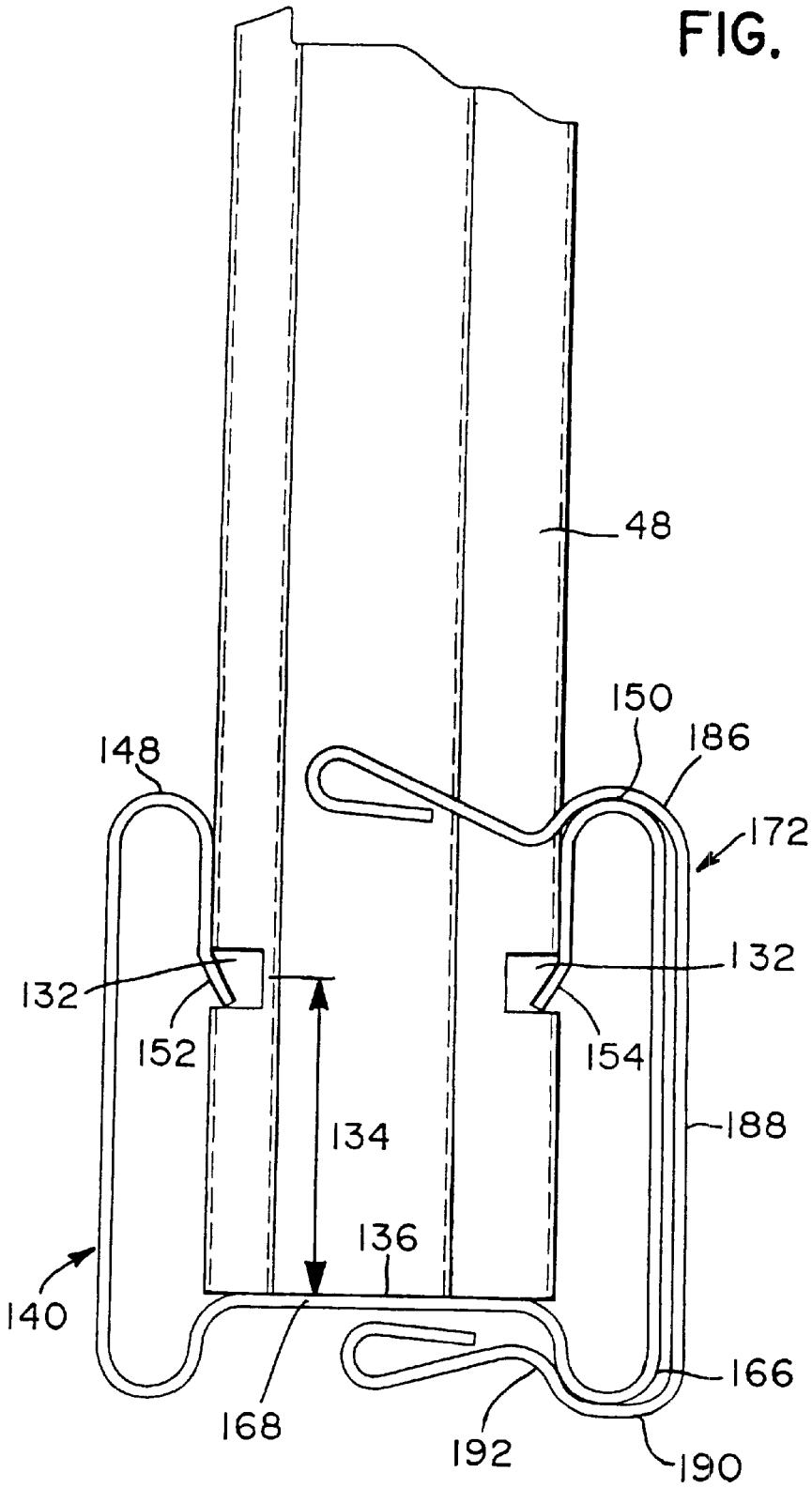
FIG. 13 is an detailed enlarged end view of a panel engaged to a panel channel further engaged to a debris deflector in accordance with the present invention.

FIG. 13 demonstrates the manner in which the standard snap-fit panel 48, panel channel 140 and debris deflector 172 work in conjunction with one another. The bottom edge 136 of the standard snap-fit panel 48 is rested on the cross web portion 168 of the panel channel 140. When the standard snap-fit panel 48 is placed on the web portion 168, the first and second aperture engaging portions 152, 154 of channel 140 engage apertures 132 of panel 48. This snap-fit engagement of apertures 132 secures the panel channel 140 to the standard snap-fit panel 48. Finally, the debris deflector 172 is snapped over the panel channel 140. Specifically, the U-shaped engaging portion 186 engages the second U-shaped portion 150, and the foot engaging portion 190 snaps over the top of the second foot portion 166 of the panel channel 140. Note that FIG. 11*b* shows, in perspective view, the snap together interrelationship between the standard snap-fit panel 48, the panel channel 140 and the debris deflector 172.

Figure 15A:
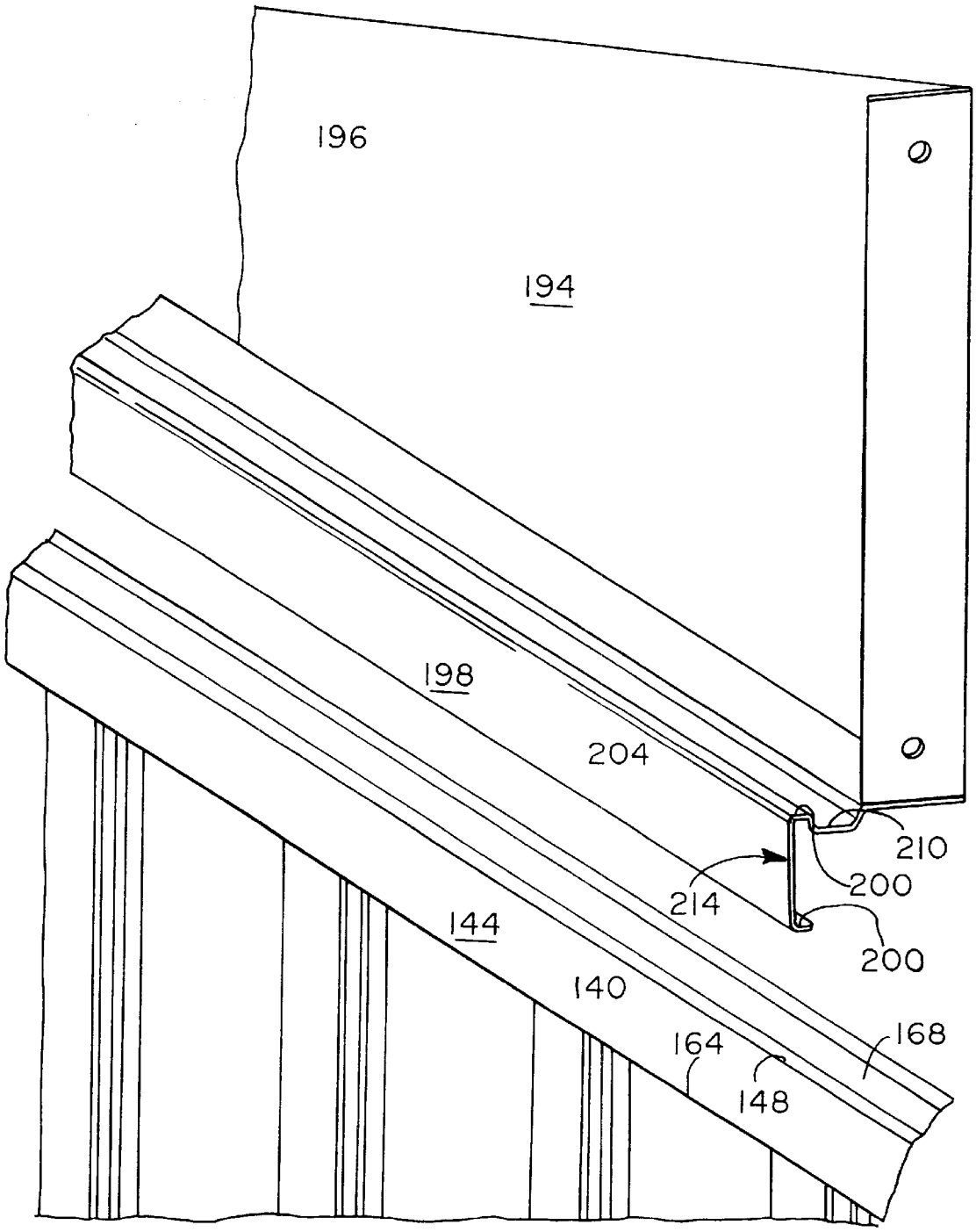
FIG. 15*a* is an enlarged perspective view of a gable about to engage a panel channel in accordance with the present invention.
Figure 15B:
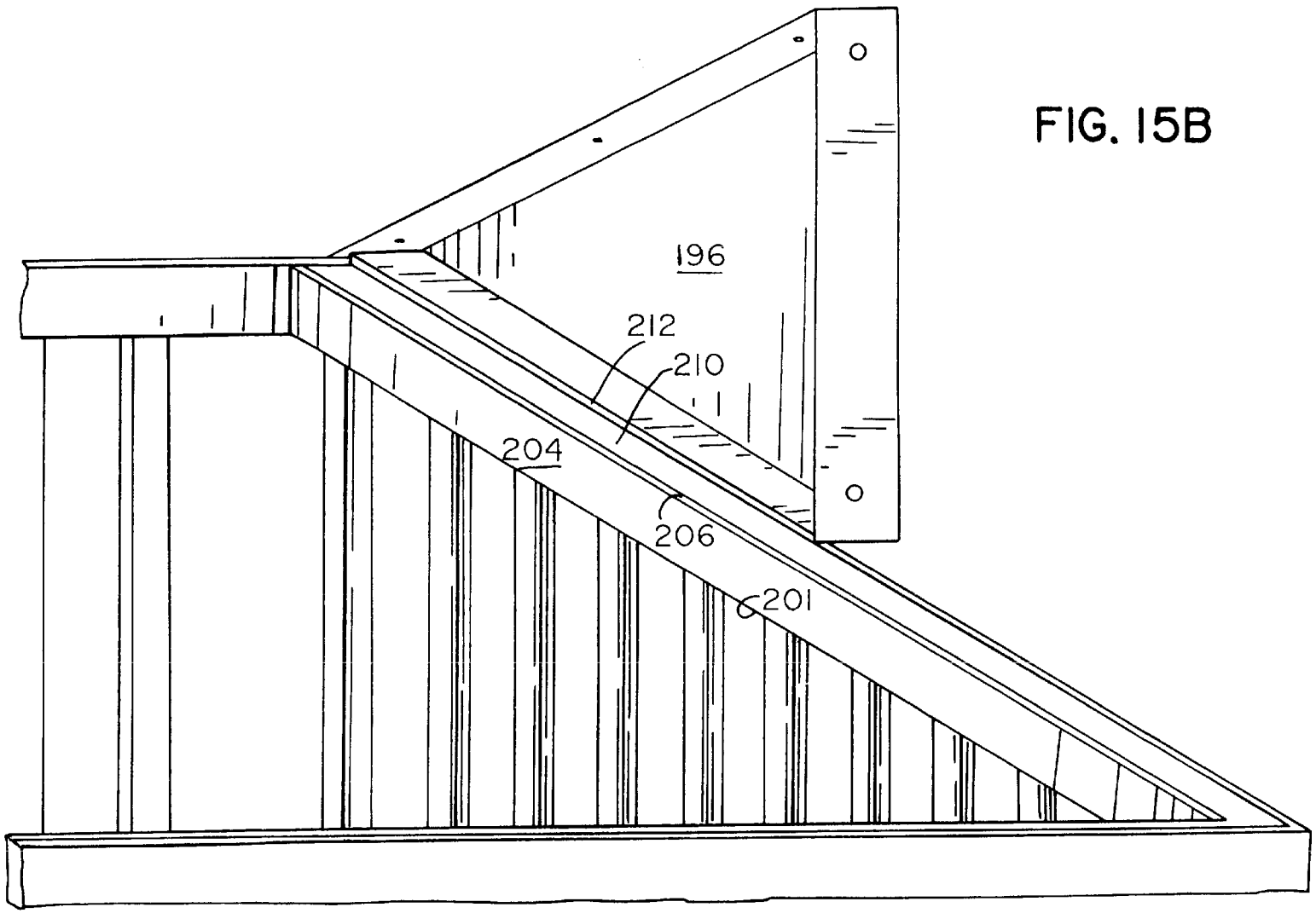
FIG. 15*b* is an enlarged perspective view of a gable engaged to a panel channel in accordance with the present invention.

As previously mentioned, the panel channel 140 may be disposed at either the bottom edge 136 or the top edge 138 of the standard snap fit panel 48. When the panel channel 140 is disposed at the bottom edge of the standard snap fit panel 48, a debris deflector 172 is preferably used to keep debris out of the gaps 170. However, when the panel channel 140 is disposed at the top edge 138 of the standard snap fit panel 48, there is little to no need for a debris deflector 172. Instead, there is a need to provide a support means for the roof structure 32. This support means comes in the form of a gable 194. The gable 194 may be constructed from plastic or sheet metal. For example, if the gable 194 is constructed from steel, it may have a thickness of about 0.36 mm. The gable 194, as best seen in FIGS. 15*a* and 15*b,* engages to the panel channel 140 in a manner similar to the way that the debris deflector 172 engages the panel channel 140. However, instead of preventing debris from entering gaps 170, the gable 194 provides support for the roof structure 32 (see FIG. 1). The gable 194 includes a substantially vertical panel 196, and a panel channel clipping portion 198.

Figure 14:
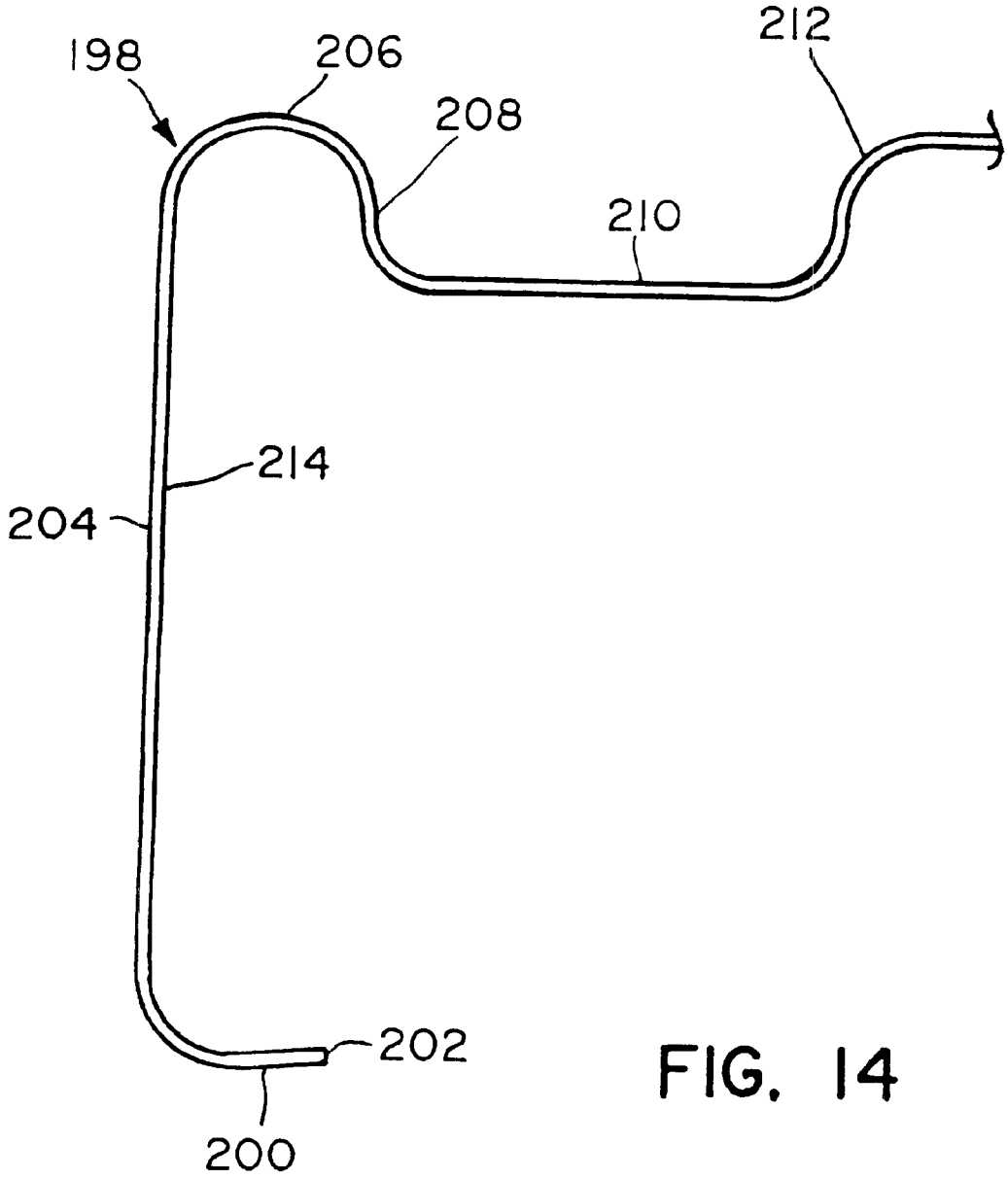
FIG. 14 is a detailed enlarged end view of the panel channel clipping portion of a gable in accordance with the present invention.

FIG. 14 demonstrates an end view of the panel channel clipping portion 198 of the gable 194. Similar to the debris deflector 172, the panel channel clipping portion 198 includes a U-shaped engaging portion 200. The U-shaped engaging portion terminates in edge 202. The panel channel clipping portion further includes a first generally planar transition portion 204, having an inner surface 214. That portion 204 attaches the U-shaped engaging portion 200 to a foot engaging portion 206. Immediately adjacent the foot engaging portion 206 is a second transition portion 208. That portion 208 connects the foot engaging portion 206 to elongated contour portion 210. Adjacent the elongated contour portion 210, is a third transition portion 212, which connects the panel channel clipping portion 198 to the rest of the gable structure 194 (See FIG. 15*a*).

As seen in FIGS. 15*a* and 15*b,* the panel channel clipping portion 198 engages the panel channel 140 in a snap-fit manner. Specifically, the U-shaped engaging portion 200 of the clipping portion 198 snaps over the U-shaped portion 164 of the panel channel 140. Then the foot engaging portion 206, in turn, is snapped over the top of the first inwardly-turned U-shaped portion 148. When the foot engaging portion 206 snaps over the foot portion 164, the elongated contour portion 210 simultaneously engages cross web 168.

Figure 16A:
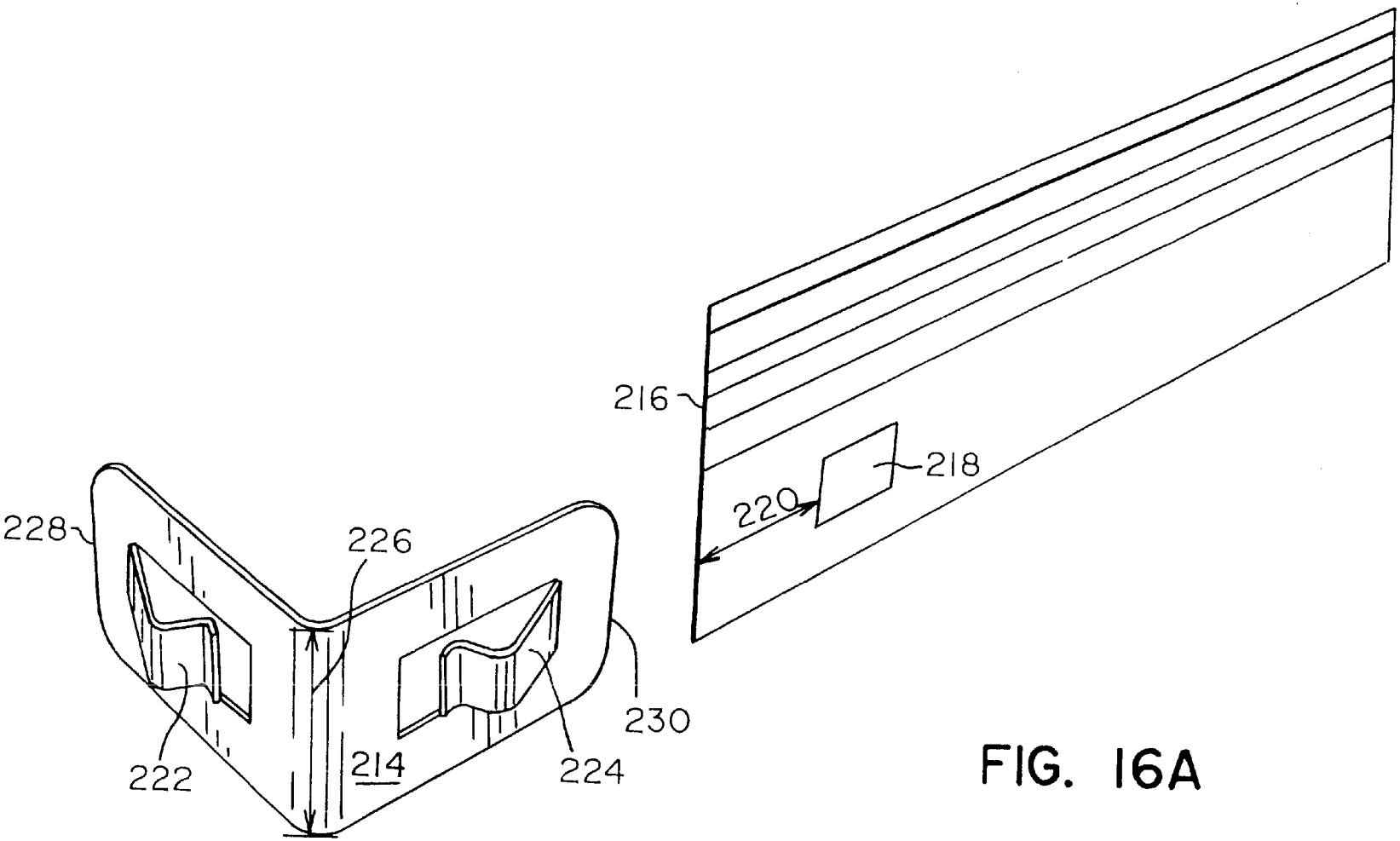
FIG. 16*a* is an enlarged perspective view of a corner bracket about to engage a panel channel in accordance with the present invention.
Figure 16B:
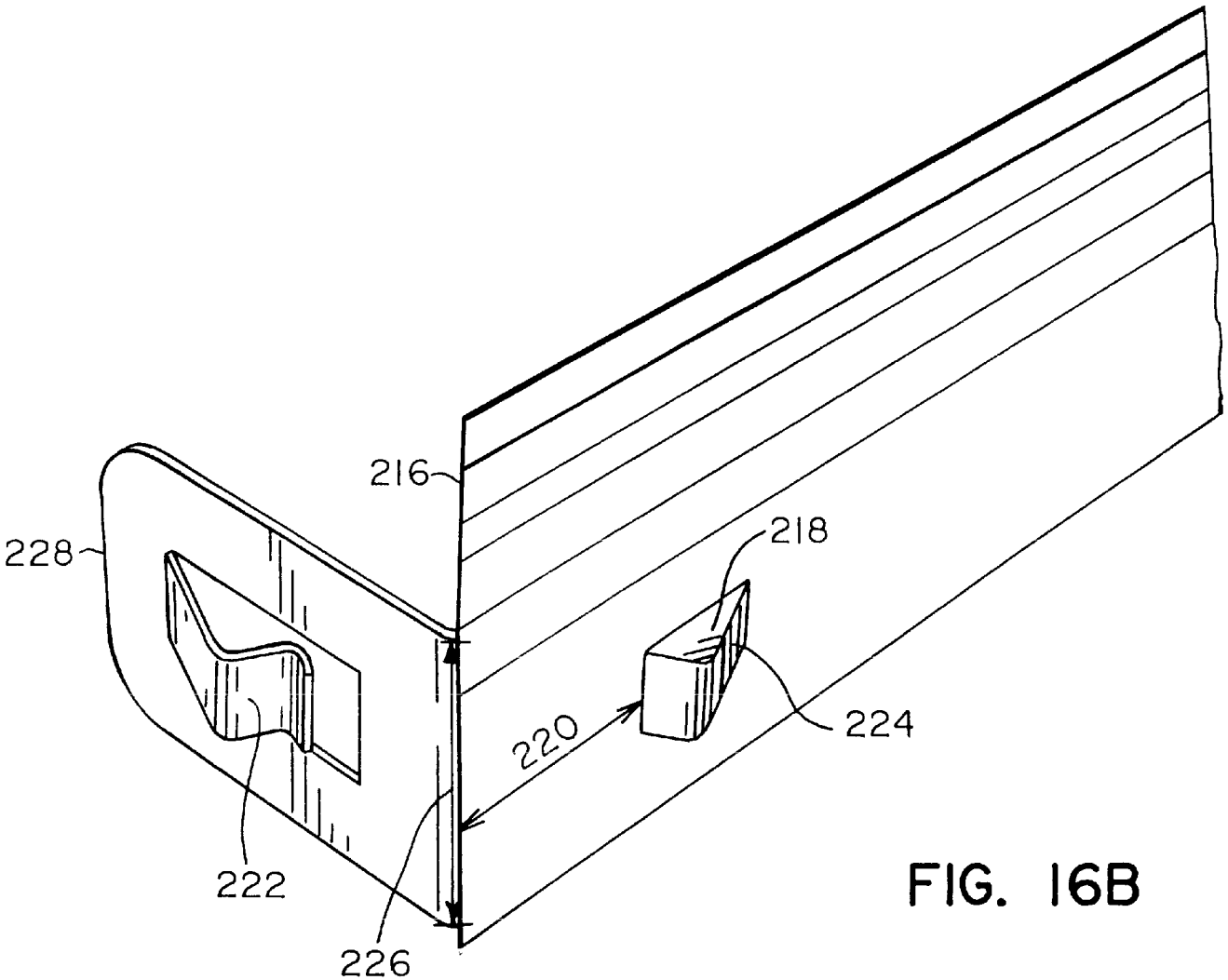
FIG. 16*b* is an enlarged perspective view of a corner bracket engaged to a panel channel in accordance with the present invention.

Referring now to FIGS. 16*a* and 16*b,* a corner connector bracket 215 is shown. The corner bracket 215 is used to secure two panel channels 140 to one another at a 90° angle. To that end, it is preferable to bevel the panel channels such that a 45° edge 216 is formed. Additionally, it is preferable that an aperture 218 is cut at a predetermined distance 220 from the 45° edge 216.

The corner bracket 215 is formed from a continuous piece of material such as plastic or sheet metal, and is bent at an approximate 90° angle. Additionally, the corner bracket 215 includes a first and second opposing aperture engaging tabs 222, 224. The height 226 of the corner bracket 215 is determined by the distance measured from the inner surface 142 of the second U-shaped portion 150 to the inside surface 142 of the second foot portion 166 of the panel channel 140. Moreover, the corner bracket 215 also includes first and second edges 228, 230. As seen in FIG. 16*a,* second edge 230 is inserted into the panel channel 140, in the space 232 bounded by the inside surface 142 of the second U-shaped portion 150 and the inside surface 142 of the second foot portion 166 of the panel channel 140.

FIG. 16*b* shows how the second opposing aperture engaging tab 224 engages aperture 218, thereby securing the corner bracket 215 into place in the panel channel 140. Although not shown, first edge 228 can also be inserted into another panel channel 140, thereby engaging the two panel channels 140 to one another at a right angle to one another such as at the corner of the shed building 20.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention as claimed.

We claim:

1. A wall panel apparatus for a storage building, comprising in combination:

a first arcuate ridged region bounded by a first inner clamping surface, and a second inner clamping surface; and a second arcuate ridged region bounded by a first outer clamping surface and a second outer clamping surface;

whereby said second arcuate ridged region of a first wall panel is adapted to securely overlap and snap-fit interconnect with said first arcuate ridged region of a second adjacent wall panel.

2. The wall panel apparatus of claim 1, wherein the wall panel has an upper edge and a lower edge, and said first and second arcuate ridged regions extend from said upper edge to said lower edge.

3. The wall panel apparatus of claim 2, wherein said first and second arcuate ridged regions each include slots located adjacent to said upper edge and said lower edge.

4. The wall panel apparatus of claim 3, wherein said slots are generally rectangular in shape.

5. The wall panel apparatus of claim 4, wherein said rectangular slots extend in a direction substantially parallel to said upper and lower edges.

6. The wall panel apparatus of claim 1, further including a first web portion forming approximately a 270° angle with said first inner clamping surface.

7. The wall panel apparatus of claim 1, further including a second web portion forming approximately a 275° angle with said second outer clamping surface.

8. A wall panel assembly for a storage building, comprising in combination:

a plurality of wall panels;

each said wall panel including a first arcuate ridged region bounded by a first clamping surface and a second inner clamping surface; and each said wall panel further including a second arcuate ridged region bounded by a first outer clamping surface and a second outer clamping surface;

whereby said second arcuate ridged region on one said wall panel is adapted to securely overlap and snap-fit to said first arcuate ridged region of an adjacent said wall panel.

9. The wall panel assembly of claim 8, wherein each said wall panel has an upper edge and a lower edge, and said first and second arcuate ridged regions extend from said the upper edge to the lower edge.

10. The wall panel assembly of claim 9, wherein said first and second arcuate regions each include slots located adjacent to said upper edge and said lower edge.

11. The wall panel assembly of claim 10, wherein said slots are generally rectangular in shape.

12. The wall panel assembly of claim 11, wherein said slots extend in a direction substantially parallel to said upper and lower edges.

13. A storage building, comprising:

a plurality of wall panels;

a plurality of channel-shaped horizontal elongate structural members;

each said wall panel including a first arcuate ridged region bounded by a first inner clamping surface and a second inner clamping surface; and each said wall panel further including a second arcuate ridged region bounded by a first outer clamping surface and a second outer clamping surface;

whereby said second arcuate ridged region of a first said wall panel is adapted to securely overlap with said first arcuate ridged region of an adjacent said wall panel to form a pair of overlapped wall panels, and further, said overlapped wall panels are adapted to be received by at least one of said channel-shaped horizontal elongate structural members.

14. The storage building of claim 13, wherein each of said wall panels has an upper edge and a lower edge, and said first and second arcuate ridged regions respectively extend from said upper edge to said lower edge.

15. The storage building of claim 14, wherein said first and second arcuate regions each include slots located adjacent to said upper edge and said lower edge.

16. The storage building of claim 15, wherein said slots are generally rectangular in shape.

17. The storage building of claim 16, wherein said slots extend in a direction substantially parallel to said upper and lower edges.

18. The storage building of claim 14, wherein said first and second arcuate regions each include slots located adjacent to said upper edge and said lower edge, and said channel-shaped horizontal elongate structural members include flange portions, each said flange portion terminating in a flange edge extending into at least one of said slots when said overlapped wall panels are received by said channel-shaped horizontal elongate structural members.

19. The storage building of claim 18, wherein said slots are rectangular.

20. The storage building of claim 19, wherein said slots extend in a direction substantially parallel to said upper and lower edges.

21. A wall panel apparatus for a storage building, comprising in combination:

a first arcuate ridged region bounded by a first clamping portion, and a second clamping portion; and a second arcuate ridged region bounded by a first clamping portion and a second clamping portion terminating in a U-shaped end portion which in turn terminates in a free terminal edge configured and adapted to be in point contact with an outer surface of said second clamping portion of said first arcuate ridged region;

whereby said second arcuate ridged region of a first wall panel is adapted to securely overlap and snap-fit interconnect with the first arcuate ridged region of a second adjacent wall panel.

22. The wall panel apparatus of claim 21, further including a first web portion forming approximately a 270° angle with said first clamping portion of said first arcuate ridged region.

23. The wall panel apparatus of claim 22, further including a second web portion forming approximately a 275° angle with said second clamping portion of said second arcuate ridged region.

24. A wall panel assembly for a storage building, comprising in combination:

a plurality of wall panels;

each said wall panel including a first arcuate ridged region bounded by a first clamping portion and a second clamping portion; and each said wall panel further including a second arcuate ridged region bounded by a first clamping portion and a second clamping portion terminating in a U-shaped end portion which in turn terminates in a free terminal edge configured and adapted to be in point contact with an outer surface of said second clamping portion of said first arcuate ridged region;

whereby said second arcuate ridged region on one said wall panel is adapted to securely overlap and snap-fit to the first arcuate ridged region of an adjacent said wall panel via said free terminal edge of said second clamping portion being in point contact with said outer surface of said second clamping portion of said first arcuate ridged region.

25. A storage building, comprising:

a plurality of wall panels;

a plurality of channel-shaped horizontal elongate structural members;

each said wall panel including a first arcuate ridged region bounded by a first clamping portion and a second clamping portion; and each said wall panel further including a second arcuate ridged region bounded by a first clamping portion and a second clamping portion terminating in a U-shaped end portion which in turn terminates in a free terminal edge configured and adapted to be in point contact with an outer surface of said second clamping portion of said first arcuate ridged region;

whereby said second arcuate ridged region of a first said wall panel is adapted to securely overlap with said first arcuate ridged region of an adjacent said wall panel to form a pair of overlapped wall panels, and further, the overlapped wall panels are adapted to be received by at least one of said channel-shaped horizontal elongate structural members.

* * * * *